219-121 SR
9/8/87 OR 4,692,582

United States Patent [19]

Marhic

[11] Patent Number: 4,692,582

[45] Date of Patent: Sep. 8, 1987

[54] PLASMA WELDING OR CUTTING SYSTEM PROVIDED WITH A DELAY

[75] Inventor: Gérard Marhic, Cergy, France

[73] Assignee: L'Air Liquide, Societe Anonyme Pour L'Etude et L'Exploitation Des Procedes Georges Claude, Paris, France

[21] Appl. No.: 830,112

[22] Filed: Feb. 18, 1986

[30] Foreign Application Priority Data

Feb. 22, 1985 [FR] France ..... 85 02554

[51] Int. Cl.[4] ..... B23K 9/00

[52] U.S. Cl. ..... 219/121 PT; 219/121 PM; 219/121 PU; 219/121 PW

[58] Field of Search ..... 219/121 PT, 121 PU, 219/121 PQ, 121 PV, 74, 75, 121 PM, 121 P, 76.16; 313/231.31, 231.51

[56] References Cited

U.S. PATENT DOCUMENTS 3,242,305 3/1966 Kane et al. ..... 219/121 P
3,433,927 3/1969 Miller ..... 219/75
4,122,327 10/1978 Vogts et al. ..... 219/121 P
4,195,216 3/1980 Beauchamp et al. ..... 219/121 PU
4,580,032 4/1986 Carkhuff ..... 219/121 PU

FOREIGN PATENT DOCUMENTS 0068270 4/1982 Japan ..... 219/121 PU

*Primary Examiner*—M. H. Paschall
*Attorney, Agent, or Firm*—Young & Thompson

[57] ABSTRACT

The plasma welding or cutting system comprises in particular a torch (2), a nozzle (3), a gas supply for the torch for supplying the torch with a plasma-producing gas, and an electrical supply for the torch for creating, maintaining or breaking an electric plasma welding or cutting arc. According to the invention, the system further comprises a delay system connected, on one hand, to the electrical supply for the torch, and, on the other hand, to the gas supply for the torch, the delay system being, when the torch is supplied by the gas supply and the electrical supply, responsive to the breaking of the electric arc of the torch and causing the closure of the gas supply after a predetermined period of time following the breaking of the electric arc so as to achieve the cooling of the torch and the maintenance of the nozzle against its seat during said period of time.

12 Claims, 5 Drawing Figures

PLASMA WELDING OR CUTTING SYSTEM PROVIDED WITH A DELAY

FIELD OF INVENTION

The present invention relates to a plasma welding or cutting system comprising in particular a torch comprising at least an electrode and a nozzle, gas supply means for the torch for supplying-plasma producing gas to the torch and electrical supply means for the torch for creating, maintaining or breaking a plasma electric welding or cutting arc.

BACKGROUND OF THE INVENTION

A system is known from U.S. Pat. No. 3,242,305 comprising a plasma torch in which the electrode and the nozzle are cooled by a stream of liquid, such as water. In this torch, the electrode is movable relative to the nozzle and to the electric contact of the nozzle when the torch is at rest. When a voltage is supplied to the torch, the cooling liquid is put under pressure by a hydraulic mechanism which causes the compression of a spring and the separation of the electrode and the nozzle, thereby creating an electric arc and priming the plasma-producing gas injected into the torch when the torch is started up. In this torch, the cooling fluid circulates as long as said system carries current, independently of the supply of gas.

It is known from French Pat. No. 2,385,483 to achieve the striking of the arc between the electrode and the nozzle by short-circuiting the electrode and the nozzle, the electrode being screwed and put into contact with the nozzle and then unscrewed, the distance between the electrode and the nozzle being then adjusted to the desired value. The torch disclosed in this patent comprises a cooling system using a liquid circulating in the region of the electrode and the nozzle. This circulation of cooling fluid occurs when the system carries current.

A torch has been proposed in French Pat. No. 2,562,748 which comprises a structure particularly well-adapted to the striking of the arc by a short-circuit between the electrode and the nozzle. More details of this striking of the arc by short-circuiting may be had by referring to French Pat. No. 2,556,549. In this process, the electrode and the nozzle are mounted to be axially movable until a mutual contact occurs in opposition to the action of an elastic return means returning the electrode and the nozzle to a maximum mutual separation position corresponding to normal operation.

The nozzle is thus freely slidably mounted in the body of the torch so as to come into contact with the electrode when the torch is applied against a workpiece. By disengaging the torch, an arc is produced between the electrode and the nozzle whereby it is possible to strike and maintain an electric arc between these parts, said arc being transferred to the workpiece to be cut.

When the electric arc is broken, the plasma-producing gas continues to be injected in the torch so long as the system carries current. This permits the cooling of the torch after use.

The system is not very economical, since plasma-producing gas is also injected in the absence of an electric arc. Further, it is found to be particularly troublesome when striking an arc by short-circuiting, since it requires great force for achieving this. If the workpiece to be cut is thin and is in overhanging relation, the striking of the arc becomes very difficult.

SUMMARY OF THE INVENTION

The system according to the invention avoids this drawback. For this purpose, it comprises delay means connected, on one hand, to the electrical supply means for the torch and, on the other hand, to the gas supply means for the torch, said delay means being responsive to the breaking of the electric arc of the torch and causing the closure of the gas supply means for the torch after a predetermined period of time following the breaking of the electric arc so as to achieve a cooling of the torch during said period of time.

According to a modification, said delay means comprise means for regulating the predetermined period of time.

Preferably, the system according to the invention is so arranged that the gas supply means comprise in particular a first electrovalve whose opening or closure controls the passage of the plasma-producing gas, the electrical circuit controlling the electrovalve being connected to the electrical supply means through the delay means.

Such a solution is fully satisfactory when, in particular, spring-type means are provided for maintaining the electrode and the nozzle spaced apart so as to avoid an untimely contact therebetween when the supply of plasma-producing gas is cut off after this delay period.

However, when the electrode and the nozzle are held apart by the flow of the plasma-producing gas itself, the latter applies the nozzle against its seat in the torch body: the cutting off of the flow of plasma-producing gas creates a new problem. The nozzle, which is movable in the torch body, can, for example, under the effect of the weight of the torch, slide in its cavity and initiate accidentally the arc-striking procedure without a deliberate action on the part of the operator.

In order to solve simultaneously the two problems presented, an object of the invention is to arrange that the gas supply means include in particular a second electrovalve having two flows, whose electrical control circuit is connected to the electrical supply means, the first flow corresponding to the stages for producing and maintaining the electric arc, the second flow, which is lower than the first flow, corresponding to the stage in which the electric arc is broken while the system is still carrying current, this second flow having sufficient value to maintain the nozzle and the electrode spaced apart irrespective of the position of the torch.

Thus, in this second embodiment of the invention, the breaking of the plasma arc produces the passage from the normal flow to the low flow of the second electrovalve, this low flow both cooling the electrode and the nozzle and maintaining the nozzle against its seat at a distance from the electrode.

According to a modification of this second embodiment of the invention, which is particularly applicable in the case where the second (low) flow of the second electrovalve is insufficient to correctly cool the electrode and the nozzle, it is arranged that the timing means be inserted between the control circuit of the second electrovalve and the electrical supply means, the gas supply means being still open when the system is carrying current so as to insure the cooling of the torch with the first flow of gas of the second electrovalve when the electric arc is broken and then the maintenance of the space between the electrode and the nozzle by means of the second flow of the second electrovalve.

According to a preferred embodiment of the invention, there will be used both the first electrovalve without delay and the second electrovalve with a calibrated discharge and provided with a delay, these two electrodes being connected in series in the plasma-producing gas supply circuits between the source of gas and the plasma torch.

Note that, when using a delay on the first electrovalve or when using the second electrovalve provided with a delay, the user may desire to reactivate the torch also during the time delay period, in the course of which the gas flow is identical to the gas flow of the torch during the welding or cutting stage. However, the force to exert on the torch for producing the short circuit is much greater than when starting without a gas flow or with a low flow of gas. It is then found that the ignition of the torch is very difficult, and in particular on a thin plate in overhanging relation.

Generally, two problems arise when using a torch of this type after a preceding cutting operation.

When the duration of the preceding cutting operation was short or when the user encountered difficulties for correctly starting up the torch, there has been no large rise in the temperature of the torch. The user must therefore be able to immediately recommence a new starting up of the torch and a new cutting operation if he desires.

When the duration of the preceding cutting operation was, on the contrary, much longer, it is usually found necessary to cool the torch before recommencing a new cutting operation so as to avoid deterioration of the torch.

In order to simultaneously solve these two problems, the invention proposes, according to a preferred embodiment, two alternatives:

The first, in which the delay has a double duration, namely a short (or zero) duration corresponding to a short utilization of the torch, the other a long duration corresponding to a longer utilization of the torch. These durations are determined in accordance with the equipment and its utilization.

The second, in which the delay varies continuously as a function of the duration of the utilization of the torch, up to a maximum threshold value, irrespective of this duration of utilization. Preferably, this delay will have zero duration when the duration of the preceding cutting stage is less than a predetermined value. Beyond a certain duration of use of the torch, the duration of the delay will be a function of the duration of the preceding cutting operation, without being able to exceed a maximum value determined experimentally as a function of the structure and the materials used in this torch. This maximum duration is that which permits bringing the temperature of the torch back to a value on the order of the surrounding temperature for a supply of gas employed with this torch. The function which defines the duration of the temperature will preferably be a function of exponential type.

In the two preceding alternatives, the corresponding electrical circuit will preferably use the charge and/or the discharge of a capacitor initiated by the start of the cutting operation so as to determine the duration of the delay. The means required for these two alternatives are part of the means for regulating the predetermined period of time.

A better understanding of the invention will be had from the description of the following embodiments, which are given by way of non-limiting examples, with reference to the accompanying drawings, in which:

DESCRIPTION OF THE PREFERRED EMBODIMENTS

Figure 1:
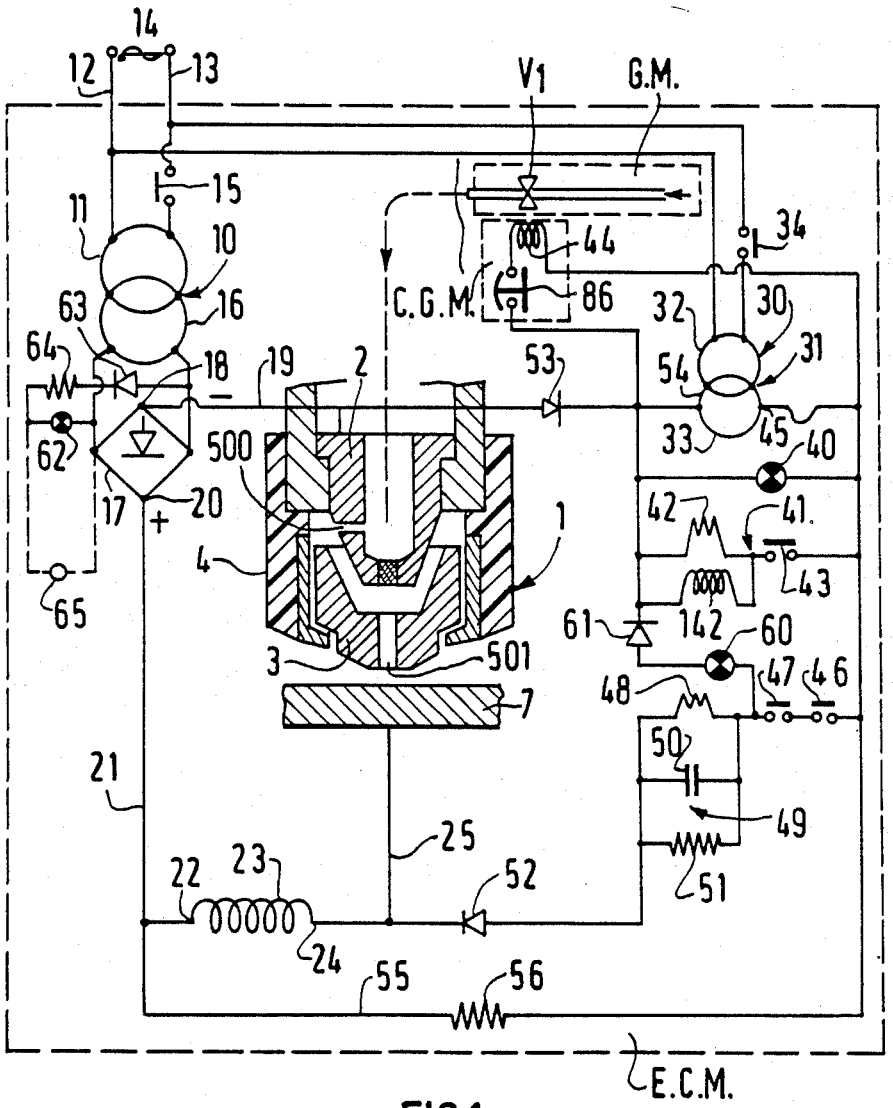
FIG. 1 is a diagrammatic view of a system according to the invention.

FIG. 1 shows a system according to the invention which comprises a torch 1 constituted by an electrode 2 and a nozzle 3 slidably mounted in the torch body 4 (with insulation with respect to the electrode 1). The system further comprises gas supply means G.M. for the torch, electrical supply means E.C.M. for the torch and delay means C.G.M., connected, on one hand, to the gas supply means G.M. and, or the other hand, to the electrical supply means E.C.M. for the torch. The torch 1 is here shown at a short distance from a workpiece 7 to be welded or cut. The electrical supply source of the torch 1 is a transformer 10 whose primary winding 11 is connected, through two conductors 12 and 13, to a main supply 14 via an automatically controlled switch 15 which may moreover be located downstream of the transformer 10. A secondary winding 16 feeds a rectifying bridge 17 whose negative terminal 18 is connected to the electrode 2 of the torch 1 through a conductor 19, while a positive terminal 20 is connected, through a conductor 21, to a terminal 22 of an inductor coil 23 whose other terminal 24 is connected, through a conductor 25 to the workpiece to be treated 7. An auxiliary control circuit 30 includes a very low voltage safety transformer 31 whose primary winding 32 is connected, through a manual swithch 34, to the main supply 14 on the upstream side of the switch 15. Connected in parallel to the terminals of the secondary winding 33 of the transformer 31 are:

a lamp 40 indicating the supply of power to the auxiliary control circuit 30, a control circuit 41 comprising a control coil 42 of the main switch 15 in series with a relay contact 43, an excitation coil 44 of an electrovalve $V_1$, connected in series with a delay device 86 of the pneumatic-electro-mechanical type (thermocouple, etc . . . ) or electronic type (monostable circuit triggered by the stopping of the arc). This unit (44 and 86) here forms the delay means C.G.M. The delay device 86 is a device which is closed when its control coil 142 is excited. When the coil 142 is no longer excited, the device 86 opens after a predetermined period of time.

A terminal 45 of the secondary winding 33 of the transformer 31 is also connected to the workpiece 7 through a circuit including in series a thermal contact 46 which opens in the event of an abnormal rise in temperature, placed in the windings of the main transformer 10, a contact 47 which closes under the effect of a gas pressure, placed in the gas supply conduit of the torch, an excitation coil 48 associated with an impedance 49 (capacitor 50 and resistor 51 in parallel), this coil 48 controlling, when excited, the closure of the contact 43, the assembly being connected, through a diode 52, to the terminal 24 of the inductor coil 23 while the negative terminal 18 is connected, through a diode 53, to the other terminal of the secondary winding 33 of the transformer 31. Further, the terminal 22 of the inductor coil 23 is connected, through a conductor 55 having a resistor 56 to the terminal 45 of the secondary winding 33 of the transformer 31.

The electrovalve V constitutes with the gas supply conduit (and the general gas supply valve, not shown) the gas supply means G.M.

The system operates in the following manner:

The operator closes the switch 34 of the auxiliary circuit 30 and opens the general plasma-producing gas supply valve, which has for effect to supply power to the very low voltage transformer 31 and to light up the indicator lamp 40. The main switch 15 is still in its open position.

The arc is formed by the electrode 2, the nozzle 3 and the workpiece 7 coming into mutual contact. The auxiliary circuit 30 feeds, by the transformer 31, the coil 48 which is excited, through the safety contacts 46 and 47 and the short circuit 2-3-7 which causes the closure of the contact 43 of the relay 48 and therefore the excitation of the coils 42 and 142, causing the closure of the supply contact 15 of the main transformer 10, and the closure of the contact 86 so that the plasma-reducing gas reaches and flows into the torch through the passages 500 and 501. The gap between the electrode 2 and the nozzle 3 forms the welding or cutting arc between the electrode 2 and the workpiece 7 and thus establishes the welding or cutting current.

The excitation of the coil 48 is maintained by the voltage at the terminals 22–24 of the inductor coil 23 which depends on the existence of the welding or the cutting current, this voltage ensuring the supply of power to the coil 48 through the conductor 55, the resistor 56, the safety contacts 46,47 and the unidirectional element 52. Upon the stopping of the welding arc caused by the operator, the coil 48 is no longer excited, the contact 43 opens, the coil 42 is also de-excited and opens the contact 15. Simultaneously, the coil 142 is also deexcited and puts the relay 86 into a timed state of rest and closes the electrovalve V whose coil 44 is no longer supplied with power. Generally, the duration of the time delay upon the closure of the electrovalve V varies between 5 and 15 seconds. This period of time is determined experimentally in accordance with the characteristics of the torch and its use.

Moreover, note that the system ceases to operate, independently of the operator, in the absence of gas presure (opening of the contact 47) or if the transformer 10 heats up abnormally (opening of the contact 46). A checking circuit (lamp 60 and the unidirectional element 61) optically indicates the correct state of the gas supply and the non-heating up of the transformer 10. Further, a lamp 62 connected in series with a unidirectional element 63 optically indicates the good state of the coil 42 and its contact 15. Preferably, the lamp 62 is connected in series with a thermocouple switch 64 so that, in normal operation, this lamp 62 lights up weakly and goes out upon stoppage of operation. On the other hand, the lamp 62 will flash in the event of a defect in the coil 42 or the contact 15, owing to the existence of a high no-load voltage at the terminals of the secondary winding 16 of the transformer 10. Preferably, a sound-producing apparatus 65 is connected in parallel with the lamp 62.

Figure 2:
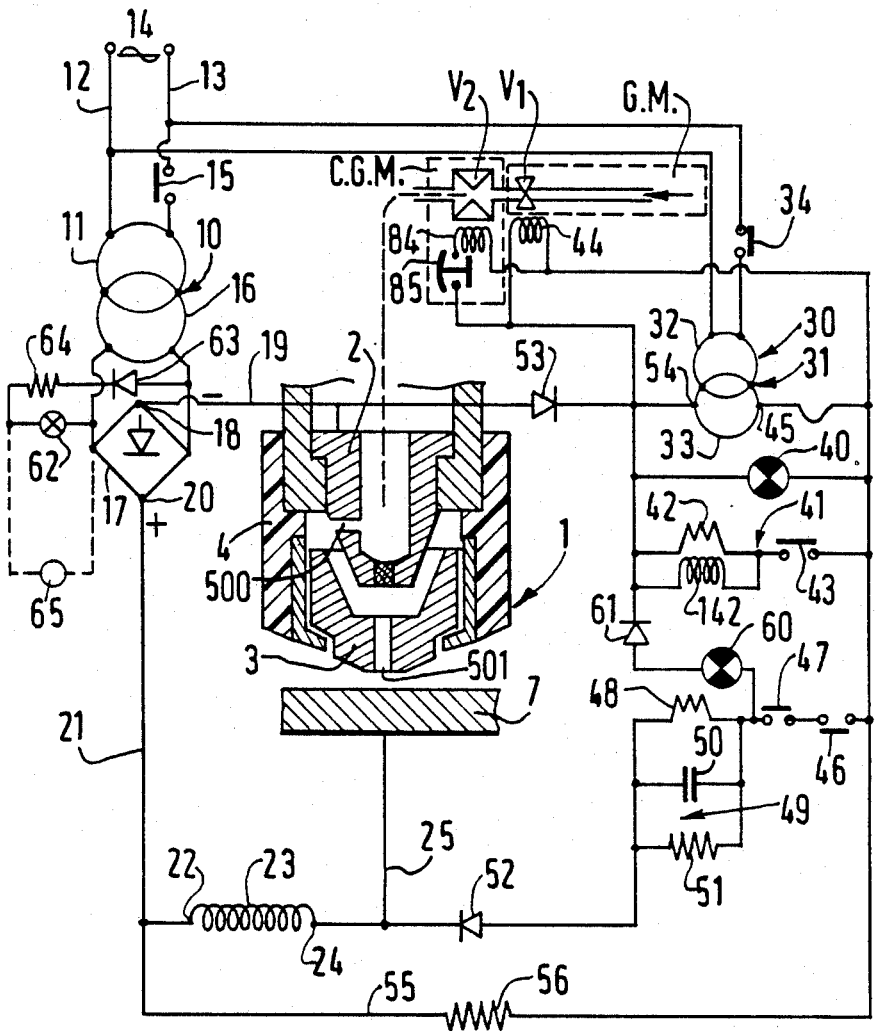
FIG. 2 is a diagrammatic view of a modification of the system according to the invention.

FIG. 2 shows a modification of the system of FIG. 1 in which the same elements as those of FIG. 1 carry the same reference numerals. The coil 44 in this modification is part of the auxiliary control circuit 30.

The delay means C.G.M. are here formed by an electrovalve $V_2$ having a double flow controlled by the coil 84 connected in series with a time delay switch 85. The ends of the coil 84 and of the time delay switch 85, which are not interconnected, are connected in parallel with the coil 44 and the terminals of the secondary winding of the transformer 31.

The first flow of the electrovalve $V_2$ corresponds to the normal flow of the system, this flow being at least equal to the flow of the electrovalve $V_1$. The second flow of the electrovalve $V_2$is low compared to the first flow and permits a calibrated escape of gas. This calibrated escape of gas has sufficient value to maintain the nozzle and the electrode spaced apart, i.e. to maintain the movable nozzle against its seat in the torch body 1. Depending on the structure of the torch, the value of this second flow is determined experimentally and the valve $V_2$ is chosen or adjusted in such manner as to obtain said flow in its second position.

The system shown in FIG. 2 operates in a manner which is in every way identical to that of the system of FIG. 1 except as concerns the delay means C.G.M.:

When the operator closes the switch 34 of the auxiliary circuit 39 this supplies current to the very low voltage transformer 31, lights up the indicator lamp 40 and excites the coil 44 of the electrovalve V so that the latter opens. The electrovalve V is closed in the calibrated escape position and allows the second flow of plasma-producing gas in the torch 1.

The welding or cutting arc is formed in the same way as before. The establishment of the arc causes the opening of the electrovalve V in its first flow position. Upon the stopping of the arc by the operator (interruption of the arc current), the coil 48 is de-excited, the contact 43 opens and this also de-excites the coils 42 and 142. The contact 15 opens and the delay switch 85 also opens after a predetermined period of time and causes the electrovalve V to change from its first flow position to its second flow or calibrated escape position. During the predetermined period of time, the flow of plasma-producing gas is maintained at its maximum value so that the torch can be rapidly cooled. The modification shown in FIG. 2 therefore corresponds to a predetermined fixed delay of the relay 85.

Of course, in this embodiment, the electrovalve V and its coil 44 may be eliminated since this electrovalve merely has the function of an electrical plasma-producing gas supply valve.

In a modification of the invention which is particularly applicable when the gas stream required for the cooling is not very large, it is also possible to eliminate the coil 142 and the time delay switch 85 in the delay circuit C.G.M. of FIG. 2. In this way, when the operator stops the welding arc, this causes, through the coil 84, the electrovalve $V_2$ to change to its low flow position, this low flow being then sufficient, on one hand, to maintain the nozzle on its seat in a position spaced away from the electrode, and, on the other hand, to cool the electrode and/or the nozzle of the torch. In this last modification, the time delay means C.G.M. are thus reduced to the means for changing the electrovalve $V_2$ from the first flow position to the second flow position.

Preferably, the second flow (calibrated escape) will be such that it cannot permit both the creation and the maintenance of a plasma arc and the sufficient cooling of the torch.

Figure 3:
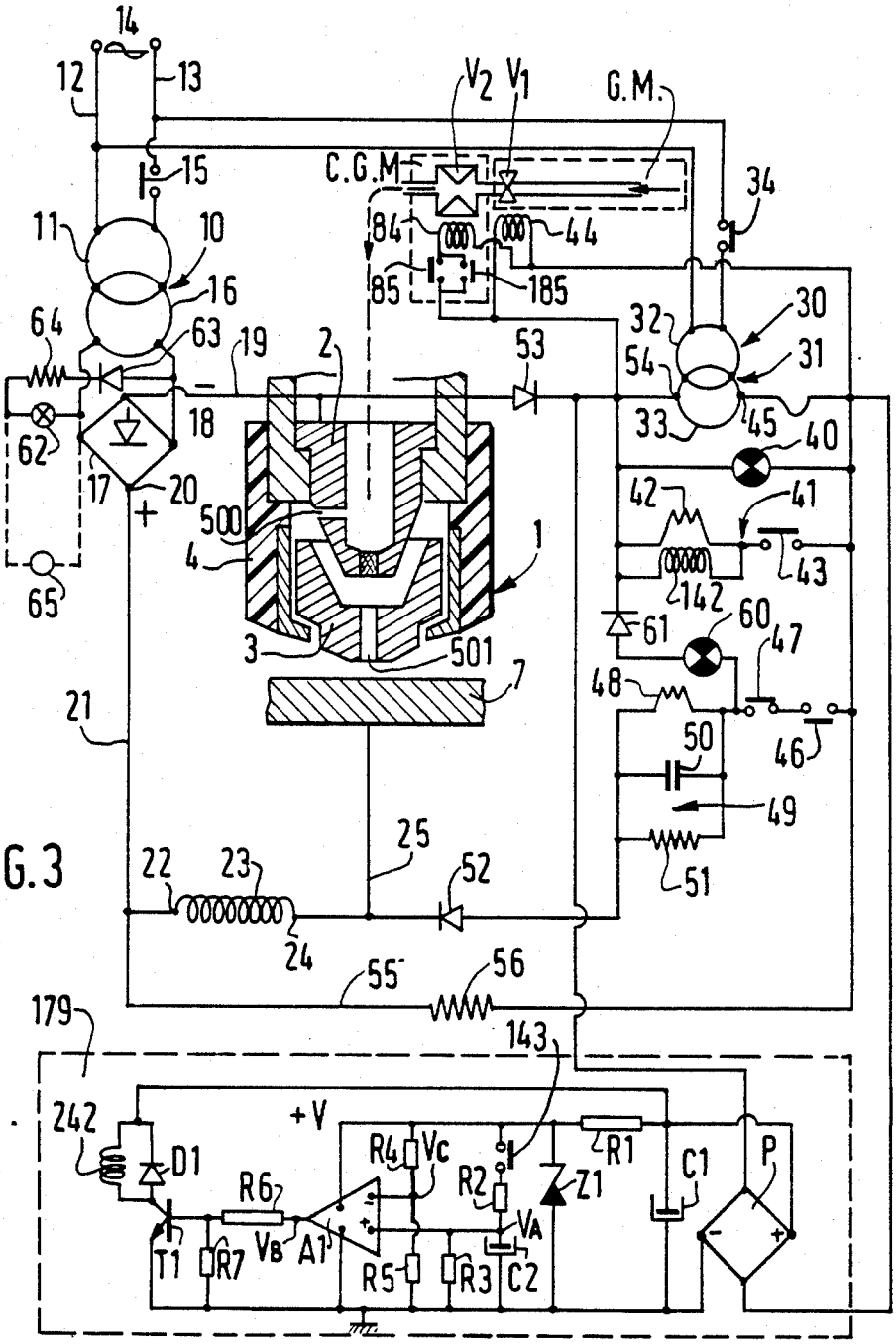
FIG. 3 is a second modification of the system of the invention with a delay which varies continuously as a function of the duration of the preceding cutting step.

FIG. 3 shows a second modification of the system according to the invention, comprising a delay device which varies in a continuous manner as a function of the duration of the preceding cutting step. The circuit shown in FIG. 3 is similar to that of FIG. 2 except for the contacts of the coil 142 and the circuit 179 which permits the variation of the delay. The delayed contact 85 of FIG. 2 has been replaced by a simple contact 85 and a second contact 185 connected in parallel with the contact 85. This contact 185 is controlled by the coil 242 as will be understood hereinafter.

To the terminals of the secondary winding 33 of the transformer 31 there is connected the circuit 179 on the input connections of a rectifier bridge P whose negative and positive outputs are connected, on one hand, to the terminals of a capacitor C1 and, on the other hand, to the resistor R1 in series with the Zener diode Z1. To the terminals of the diode Z1 which delivers a stabilized voltage V of a value equal to its Zener voltage, there is connected the first end of the contact 143 whose other end is connected to the resistor R2 which is connected in series with the capacitor C2 whose negative plate is connected to ground. Also connected to the terminals of this diode Z1 is a divider bridge R4–R5 whose mid-point (at voltage $V_c$) is connected to the negative input of a comparitor amplifier A1 whose positive input is connected to the point common to the resistor R2 and the capacitor C2 (at voltage $V_A$), this common point being also connected to ground through the resistor R3 so as to permit (when necessary) the discharge of the capacitor C2. The comparator amplifier A1 is supplied at voltage V while the output of A1 (at voltage $V_B$) is connected through a resistor R6 to the base of a transistor T1 whose emitter is connected to ground (negative pole of the rectifier bridge P). The base of T1 is also grounded through the resistor R7. The collector of T1 is polarized through the coil 242 which controls the opening or closing of the contact 185, a diode D1 being connected in parallel with the coil 242 in the direction of conduction from the collector to the chosen positibe supply at the common point of $R_1$ and $C_1$.

Figure 4:
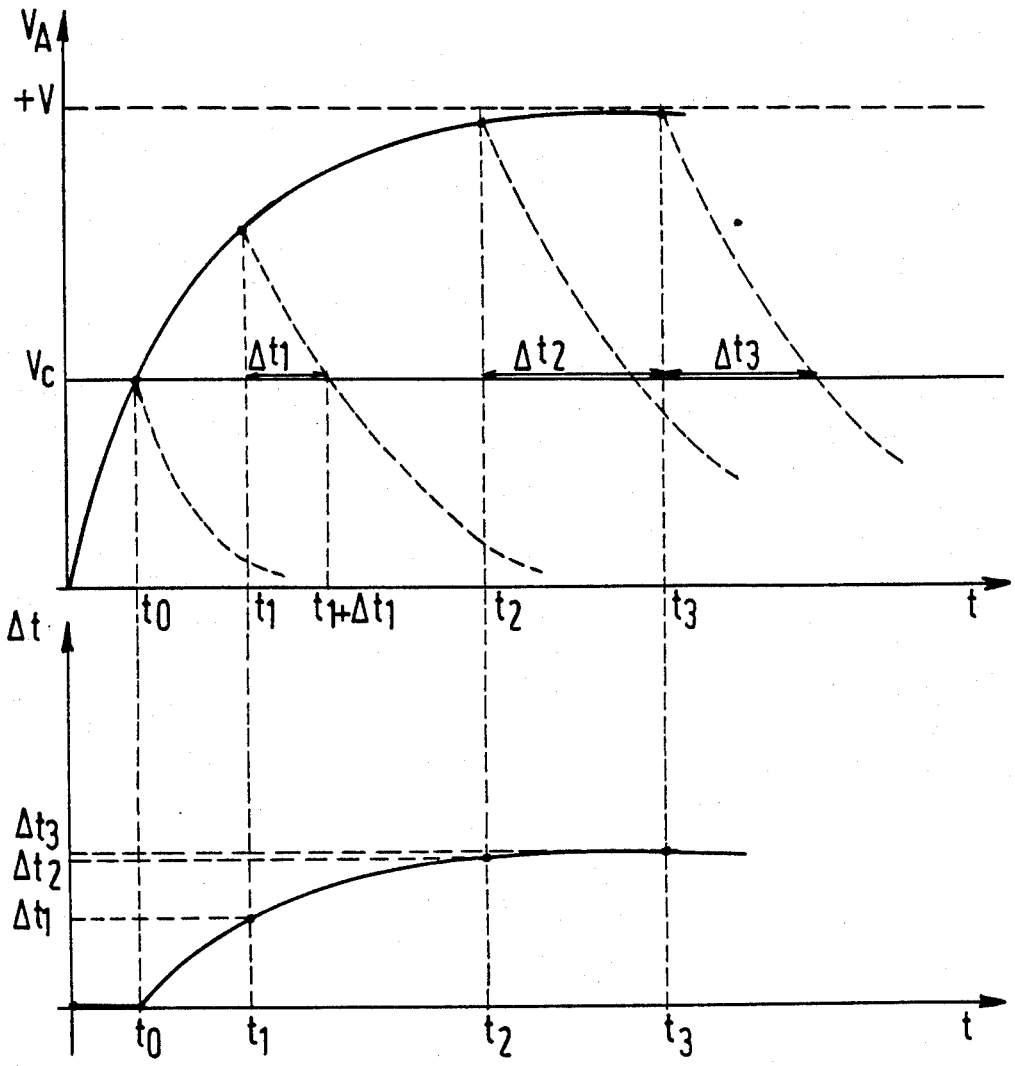
FIG. 4 shows a curve illustrating the operation of the modification shown in FIG. 3.

The operation of the device, illustrated in FIG. 3, will be better understood by reference to FIG. 4 which shows, on the curve located in the upper part of the figure, the variation of the voltage $V_A$ as a function of time t, and on the curve in the lower part of the figure, the duration $\Delta t$ of the time delay as a function of the duration t of the cutting.

The cutting circuit is started up in the same way as for that shown in FIG. 2. When the coil 142 is excited, the contact 85 is closed and this results in a "high flow" of gas during the cutting period. Up to instant $t_o$, as the voltage at the negative input of the comparator amplifier A1 is higher than that at the positive input, the transistor T1 is turned off and the coil 242 is not excited. The switch 185 is open. When the cutting operation is stopped, the contact 85 is also opened which results in a de-excitation of the coil 84, the valve V2 immediately changing to the "low flow" position.

When the duration of the cutting operation is long enough to become greater than $t_o$, the voltage $V_A$ at the positive input of the comparator amplifier A1 becomes higher than the voltage fixed by the divider bridge R4 R5 on the negative input of $A_1$. This results in a positive voltage on the base of the transistor T1 which becomes conductive; the coil 242 is excited and this causes the closure of the contact 185. If the cutting operation is stopped at instant $t_1$, the coil 142 is de-excited and the contact 85 opened. The contact 143, whose closure was brought about by the excitation of the coil 48 (see description with reference to FIG. 2), is opened and this results in the discharge of the capcitor C2 through the resistor R3. After the period of time $\Delta t$, the voltage at the terminals of the capacitor C2 become again equal to $V_C$, and the coil 242 is de-excited, which then causes the opening of the contact 185 and the de-excitation of the coil 84: the valve $V_2$, in the "high flow" position when the coil 84 is excited, then changes to the "low flow" position.

FIG. 4 shows moreover that if the cutting operation is stopped at instants $t_2$ or $t_3$, . . . , there is obtained a time delay $\Delta t$ of duration $\Delta t_2$, $\Delta t_3$, . . . . When the duration of the cutting operation is such that the capacitor is fully charged (voltage V between the plates), the duration $\Delta t$ of the time delay becomes substantially constant ($\Delta t_2$ substantially equal to $\Delta t_3$).

Figure 5:
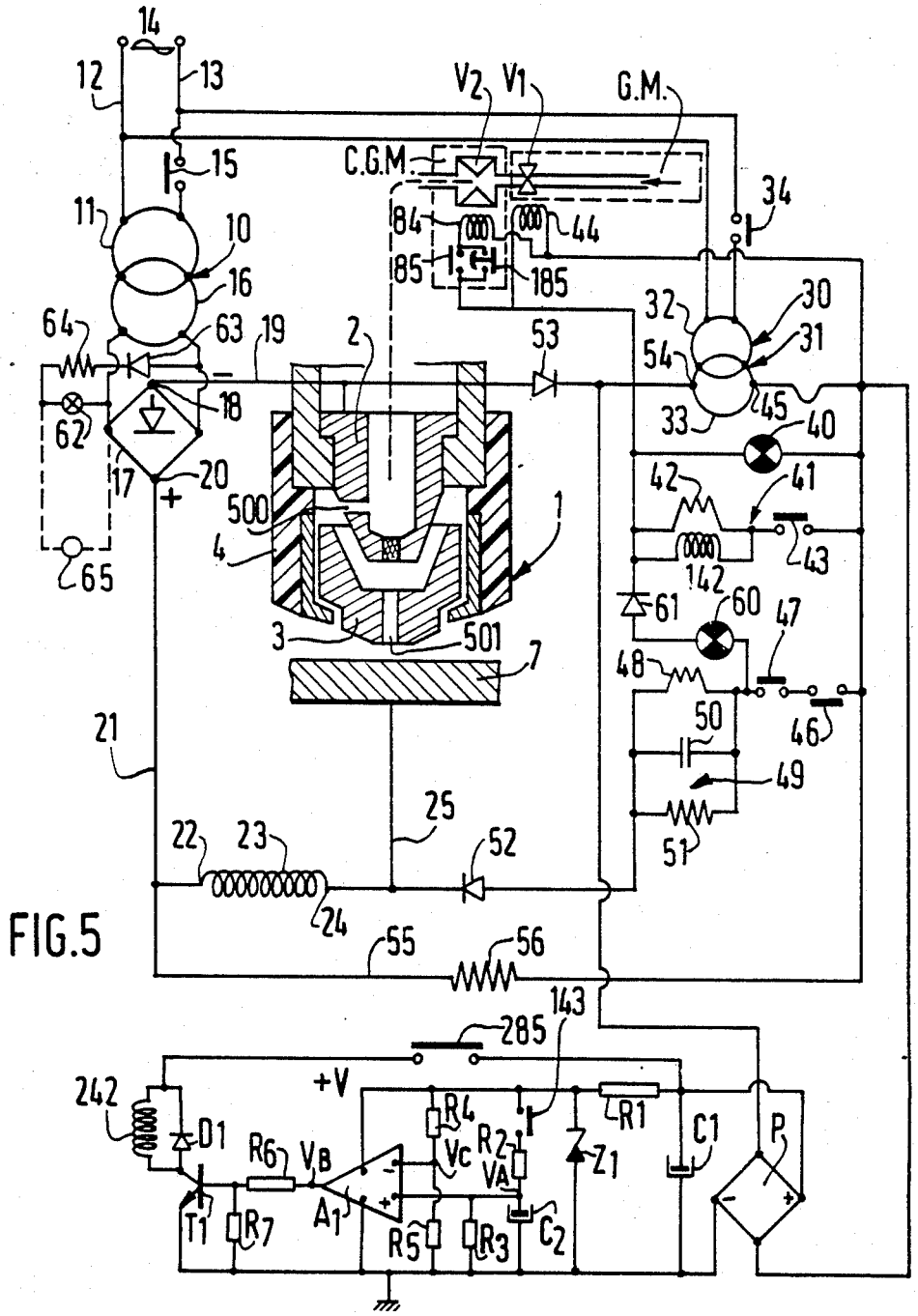
FIG. 5 is a diagrammatic view of a third modification having a delay of double duration.

FIG. 5 shows a third modification of the system according to the invention comprising a delay of double duration. When the duration of the cutting operation has been less than a predetermined value, the delay has a short duration of predetermined value, which may possibly be adjustable. This short duration is generally nil. When the duration of the cutting step is greater than this predetermined value (cutting of long duration), the time delay takes on a second, possibly adjustable, predetermined value which is longer than the preceding value. However, in practice, the duration of the longest of the delays usually does not exceed a few seconds.

The circuit shown in FIG. 5 is substantially identical to that shown in FIG. 4 with, however, the following differences: the contact 185 has been replaced by a time delay contact 385 in parallel with the contact 185, while the collector T1 is supplied with current through the coil 242 via a contact 285 the closing and opening of which are controlled by the excitation and the de-excitation of the coil 142 which also causes the closing and opening of the contact 85.

The circuit shown in FIG. 5 operates in the following manner: at instant $t_o$, when the cutting operation starts, the coil 142 is excited and the contact 85 is closed, which causes the passage of the gas at a high flow in $V_2$. If the cutting is stopped before the instant $t_1$ (see FIG. 4), the coil 242 is not excited and the contact 385 remains open. As the stoppage of the cutting results in the opening of the contact 85, the high flow of gas is also stopped and a "low flow" of gas passes through the valve $V_2$. Consequently, there is no delay in the present case.

On the other hand, if the cutting operation is stopped beyond the instant $t_1$, the situation is quite different. From instant $t_1$, the comparator A1 changes and the coil 242 is excited, since the contact 285 was closed at instant $t_o$ when the coil 142 was excited. If the cutting is stopped at instant $t_3$, for example (FIG. 4), the coil 142 is de-excited and this causes, on one hand, the opening of the contact 85 and, on the other hand, the opening of the contact 285. The opening of the latter results in the de-excitation of the coil 242 which brings about the delayed opening of the contact 385. In this way there is maintained a "high flow" of gas in the valve $V_2$ and in the nozzle after the end of the cutting step, the duration of this high flow being equal to the value of the delay of the delay switch 385. As before, this value generally does not exceed a few seconds.

It will be understood that one skilled in the art may make the modifications shown in FIGS. 3 and 5 in various ways without departing from the scope of the invention defined in the appended claims, by using for example logic circuits (logic gates, counters, etc . . . ) operating with digital signals triggered by the start and the end of the cutting operations, or delay relays (in particular in respect of the modification of FIG. 5). In particular, it is possible, by using digital logic circuits, to modify the curve $\Delta t = f(t)$ (example: FIG. 4) in such manner as to give it the desired form in accordance with a linear, polynominal function, etc. . . . The purpose of the variable delay is to provide a cooling period which is a direct function of the temperature of the torch after the preceding cutting operation. For this purpose, the heating curve of the torch may be experimentally plotted (in a given point of the latter, for example in the vicinity of the electrode) as a function of the cutting duration and the same curve maybe substantially reproduced for the variable delay.

Although it is possible to use two different gases for achieving two different flows, with two separate supply circuits leading to the electrovalve $V_2$, each circuit being controlled in synchronization with the switching of the valve from the first to the second flow and vice-versa, it will usually be more simple to use the same gas for the two flows.

What is claimed is:

1. A gas-cooled plasma welding or cutting system comprising: a torch including a torch body, at least one electrode mounted in said body and a nozzle having a gas outlet orifice; gas supply means for providing said torch with plasma-producing gas; and electrical supply means for producing, maintaining or breaking a plasma welding or cutting arc, wherein said nozzle is axially movable relative to said torch body between an arc-producing position in which it engages the electrode and a normal operation position spaced from the electrode and is provided with elastic return means elastically yielding the nozzle towards its normal operation position, said return means comprising a gas flow, said system further comprising means for providing a maximum gas flow during a cutting operation which is responsive to the breaking of said arc to at least reduce said gas flow after a predetermined period of time following said arc breaking.

2. A plasma welding or cutting system according to cliam 1, further comprising delay means connected to the electrical supply means and the gas supply means for regulation said predetermined period of time.

3. A plasma welding or cutting system according to claim 2, wherein the delay means for regulating the predetermined period of time are such that the delay is a function of the duration of the preceding cutting.

4. Plasma welding or cutting system according to claim 1, wherein the gas supply means comprise a first electrovalve whose opening or closing controls the passage of the plasma-producing gas, an electrical control circuit for the electrovalve being connected to the electrical supply means through a delay means.

5. A plasma welding or cutting system according to claim 1, wherein the elastic return means is the flow of the plasma-producing gas and the gas supply means comprises as electrovalve providing two gas flows, an electrical control circuit for the electrovalve being connected to the electrical supply means, the first flow of the electrovalve being a high-flow and corresponding to stages for creating and maintaining the electric arc, the flow of the second electrovalve being lower than the first flow and corresponding to a stage in which the electric arc is broken while the system is still supplied with current, said second flow having sufficient value to maintain the nozzle and the electrode spaced apart irrespective of the position of the torch.

6. A plasma welding or cutting system according to claim 2, wherein the delay means for regulating the predetermined period of time comprise means for measuring the duration of the cutting operation, means for comparing said duration of the cutting operation with a predetermined value, and means for causing the interruption of a high-flow cutting gas supply as soon as the cutting operation ceases, when the duration of the cutting operation is less than said predetermined value.

7. A plasma welding or cutting system according to claim 6, wherein the delay means for regulating the predetermined period of time further comprise means for causing the interruption of the high-flow gas supply after a predetermined period of time following the end of the cutting operation, when the duration of the preceding cutting operation is at least said predetermined value.

8. A plasma welding or cutting system according to claim 6, wherein the delay means for regulating the predetermined period of time further comprise means for causing the interruption of the high-flow gas supply after a period of time following the end of the cutting operation which is a function of the duration of the cutting operation.

9. A plasma welding or cutting system according to claim 1, wherein the duration of the predetermined period of time is a function of the temperature of the torch at the end of the cutting operation.

10. A gas-cooled plasma welding or cutting system comprising: a torch including a torch body, at least one electrode mounted in said body and a nozzle having a gas outlet orifice; gas supply means for providing said torch with plasma-producing gas; and electrical supply means for producing, maintaining or breaking a plasma welding or cutting electric arc, wherein said nozzle is axially movable relative to said torch body between an arc-producing position in which it engages the electrode and a normal operation position spaced from the electrode and is provided with elastic return means elastically yielding the nozzle towards its normal operation position, said return means comprising a gas flow, said system comprising means for providing a maximum gas flow during a cutting operation, and means for at least reducing the gas flow after a period of time following a breaking of said arc following said arc breaking.

11. A gas-cooled plasma welding or cutting system comprising: a torch including a torch body, at least one electrode mounted in said body and a nozzle having a gas outlet orifice; gas supply means for providing said torch with plasma-producing gas; and electrical supply means for producing, maintaining or breaking a plasma welding or cutting arc, wherein said nozzle is axially movable relative to said torch body between an arc-producing position in which it engages the electrode and a normal operation position spaced from the electrode and is provided with elastic return means elastically yielding the nozzle towards its normal operation position, said return means comprising a gas flow, said system comprising means for providing a maximum gas flow during a cutting operation, and said system further comprising means for maintaining a reduced gas flow both before and after a cutting operation as long as said system is supplied with current following said arc breaking.

12. A plasma welding or cutting system according to claim 11, wherein said gas flow is the sole means for elastically returning the nozzle away from the electrode.

* * * * *